US009121219B2

(12) United States Patent
Ng

(10) Patent No.: US 9,121,219 B2
(45) Date of Patent: Sep. 1, 2015

(54) ROMAN BLIND

(71) Applicant: Philip Ng, Thornhill (CA)

(72) Inventor: Philip Ng, Thornhill (CA)

( * ) Notice: Subject to any disclaimer, the term of this patent is extended or adjusted under 35 U.S.C. 154(b) by 90 days.

(21) Appl. No.: 14/063,092

(22) Filed: Oct. 25, 2013

(65) Prior Publication Data

US 2015/0114575 A1 Apr. 30, 2015

(51) Int. Cl.
*E06B 9/262* (2006.01)
*E06B 9/26* (2006.01)

(52) U.S. Cl.
CPC ..... *E06B 9/26* (2013.01); *E06B 2009/2622* (2013.01)

(58) Field of Classification Search
USPC ..... 160/84.01, 84.04, 84.06, 340, 384
IPC ..... E06B 2009/2622,2009/2625
See application file for complete search history.

(56) References Cited

U.S. PATENT DOCUMENTS

| | | | | | |
|---|---|---|---|---|---|
| 600,852 | A * | 3/1898 | Baisley | 160/393 |
| 793,967 | A * | 7/1905 | Upperman | 160/330 |
| 867,750 | A * | 10/1907 | Pfleghardt | 160/398 |
| 3,817,309 | A * | 6/1974 | Takazawa | 160/84.01 |
| 5,819,836 | A * | 10/1998 | Keil | 160/384 |
| 6,038,800 | A * | 3/2000 | Seidel | 40/517 |
| 6,116,319 | A * | 9/2000 | Simon | 160/84.01 |
| 7,159,347 | B1 * | 1/2007 | Ngan | 40/514 |
| 8,066,050 | B2 * | 11/2011 | Lin | 160/84.04 |
| 8,186,411 | B2 * | 5/2012 | Lin | 160/84.01 |
| 8,186,412 | B2 * | 5/2012 | Lin | 160/84.01 |
| 8,281,842 | B2 * | 10/2012 | Lin | 160/84.04 |
| 8,695,676 | B2 * | 4/2014 | Lin | 160/84.01 |
| 8,763,671 | B2 * | 7/2014 | Vestal | 160/84.01 |
| 2011/0247763 | A1 * | 10/2011 | Hu et al. | 160/84.03 |

* cited by examiner

*Primary Examiner* — David Purol
(74) *Attorney, Agent, or Firm* — Elias Borges

(57) ABSTRACT

An improved roman blind includes a shade and a plurality of horizontal support bars mounted along the shade. Each of the support bars has a guide dimensioned to receive a lifting ribbon. The blind includes a lift mechanism to raise and lower the lifting ribbon. An adjustable mounting element mounted to the second end of the lifting ribbon is also provided; the adjustable mounting element including first and second elongated members having opposite first and second ends. The opposite ends of the elongated members are configured to couple the elongated members together and clamp an end of the ribbon between the elongated members, a portion of the ribbon adjacent the second end being wrapped around the coupled elongated members. The adjustable mounting element further includes an elongated lock member which prevents the ribbon from unwrapping off the elongated members, the elongated lock member being mounted to a lowermost support bar.

4 Claims, 8 Drawing Sheets

ROMAN BLIND

FIELD OF THE INVENTION

The invention relates generally to roman blinds having adjustable shade lifting chords and ribbons.

BACKGROUND OF THE INVENTION

Roman blinds are a popular form of window covering. They generally consist of a fabric shade to which a plurality of parallel horizontal support rods are mounted. A pair of lift chords are mounted between the lowermost horizontal support rod and a lifting mechanism at the top of the blind. The lifting mechanism lifts and lowers the lowermost support rod. The lift chords pass through guides (loops) formed on the horizontal support rod so that as the lowermost support rod is lifted, the blind tends to form horizontal folds along the horizontal support rods. Over the past few years, lift chords have been replaced by lifting ribbons (flat webbing) which winds around a roller tube set in the lifting mechanism.

Installing the roman blind can be a time consuming task, particularly adjusting the length of the support ribbons. If the ribbons are left too long, they will appear unsightly and will sag. If the ribbons are cut too short, then the blind cannot be fully lowered. Careful measurements must be made in order to properly size the lift ribbons. Despite careful measurements, the nuances of fit and finish when actually installing the roman blind often results in the ribbon being cut to the wrong size. A quick and convenient way to adjust the length of the support ribbon is therefore required.

SUMMARY OF THE INVENTION

In accordance with one aspect of the present invention, there is provided a roman blind which is easy to assemble and adjust. The roman blind includes a shade having a top and bottom edge, and a plurality of support bars mounted along the shade between the top and bottom edges of the shade in a parallel horizontal fashion. Each of the support bars has a loop dimensioned to receive a lifting ribbon having opposite first and second ends. The blind also includes a lift mechanism is mounted to the top end of the shade, the lift mechanism being mounted to the first end of the lifting ribbon and configured to raise and lower the lifting ribbon. An adjustable mounting element mounted to the second end of the lifting ribbon is also provided; the adjustable mounting element including first and second elongated members having opposite first and second ends. The opposite ends of the elongated members are configured to couple the elongated members together and clamp the second end of the ribbon between the elongated members, a portion of the ribbon adjacent the second end being wrapped around the coupled elongated members. The adjustable mounting element further includes an elongated lock member having opposite ends, the lock member being dimensioned such that the opposite ends of the lock member align with and lock to the opposite ends of the elongated members preventing the ribbon from unwrapping off the elongated members. Finally, the elongated lock member has mounting elements for mounting to a lowermost support bar mounted adjacent the bottom edge of the shade.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
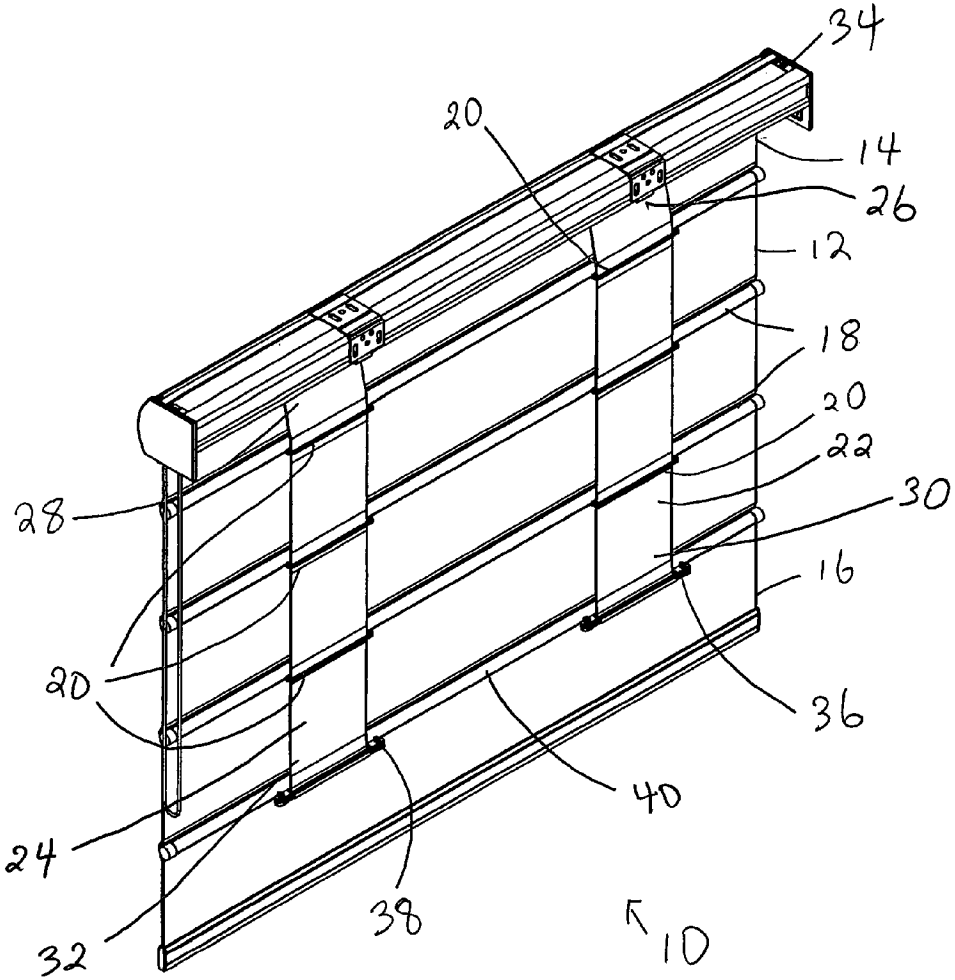
FIG. 1 is a perspective view of a roman blind made in accordance with the present invention.
Figure 2:
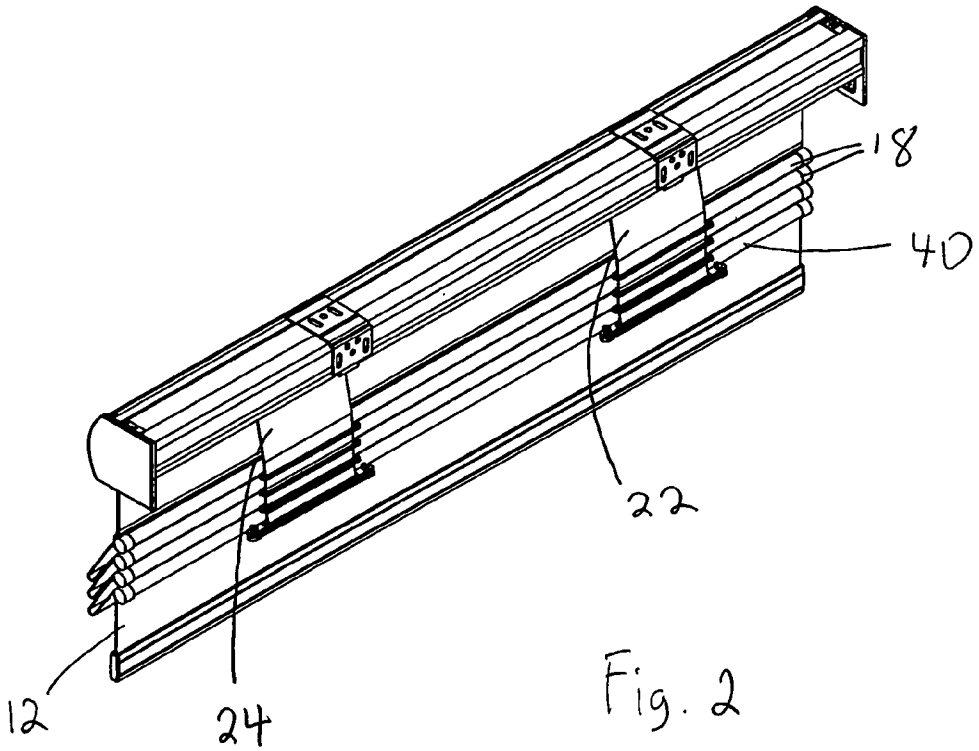
FIG. 2 is a perspective view of the roman blind shown in FIG. 1 with the blind drawn up.

Referring to FIGS. 1, a roman blind made in accordance with the present invention is shown generally as item 10 and includes shade 12 having upper end 14 and lower end 16. Support bars 18 are mounted to shade 12 in a parallel and horizontal fashion. Support bars 18 are provided with guide loops 20 which are dimensioned and configured to receive support ribbons 22 and 24. Support ribbons 22 and 24 have upper ends 26 and 28, and lower ends 30 and 32, respectively. Upper end 14 of shade 12 is mounted to head rail 34 as are upper ends 26 and 28 of ribbons 22 and 24. Head rail 34 is provided with lifting means (not shown) for raising and lowering ribbons 22 and 24. Lowermost horizontal support rod 40 is mounted to lower ends 30 and 32 of ribbons 22 and 24 by adjustable mounting elements 36 and 38, respectively. Lowermost horizontal support rod 40 is mounted to shade 12 adjacent lower end 16 so that when support ribbons 22 and 24 are lifted, lowermost support rod 40 lifts the shade. Guide loops 20 are dimensioned to permit the support ribbons to easily pass through, creating a roman blind effect on shade 12 when the shade is lifted (see FIG. 2).

Figure 3:
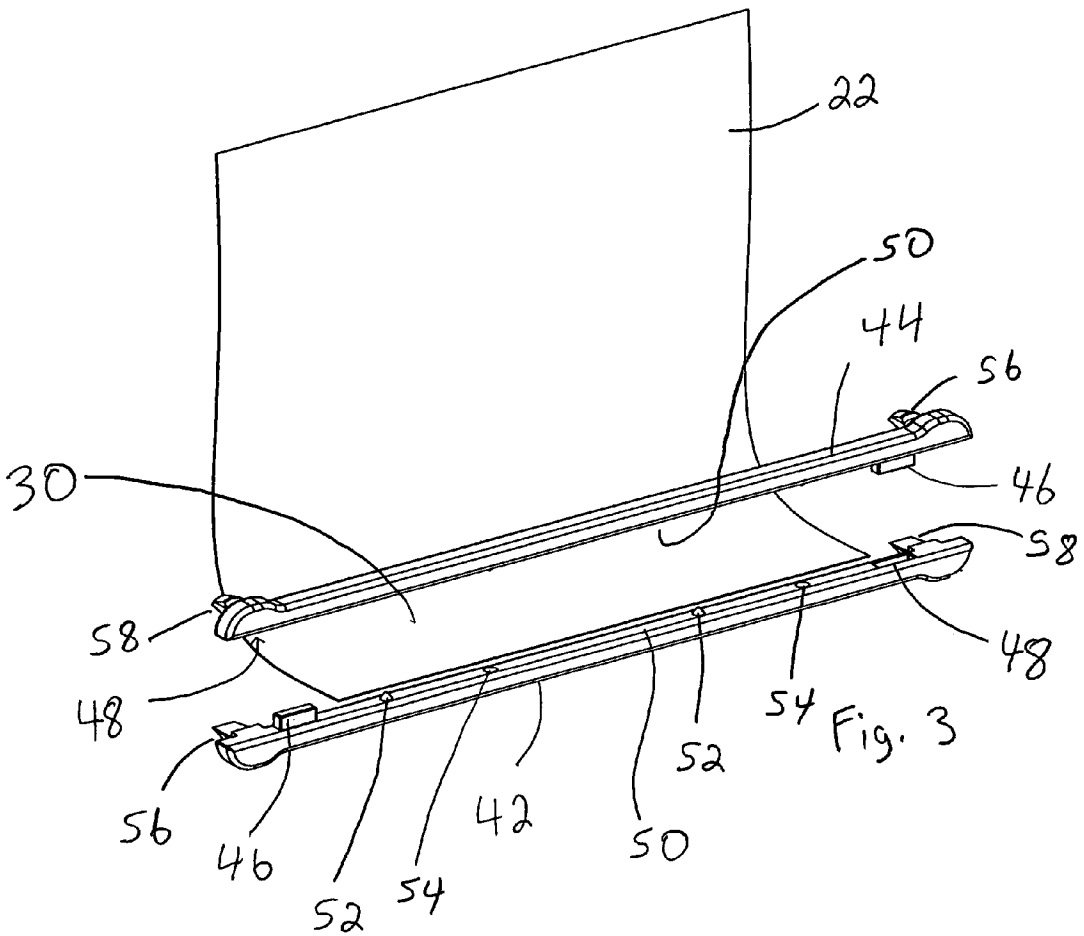
FIG. 3 is a perspective view of an adjustable mounting element used to construct a roman blind made in accordance with the present invention.
Figure 4:
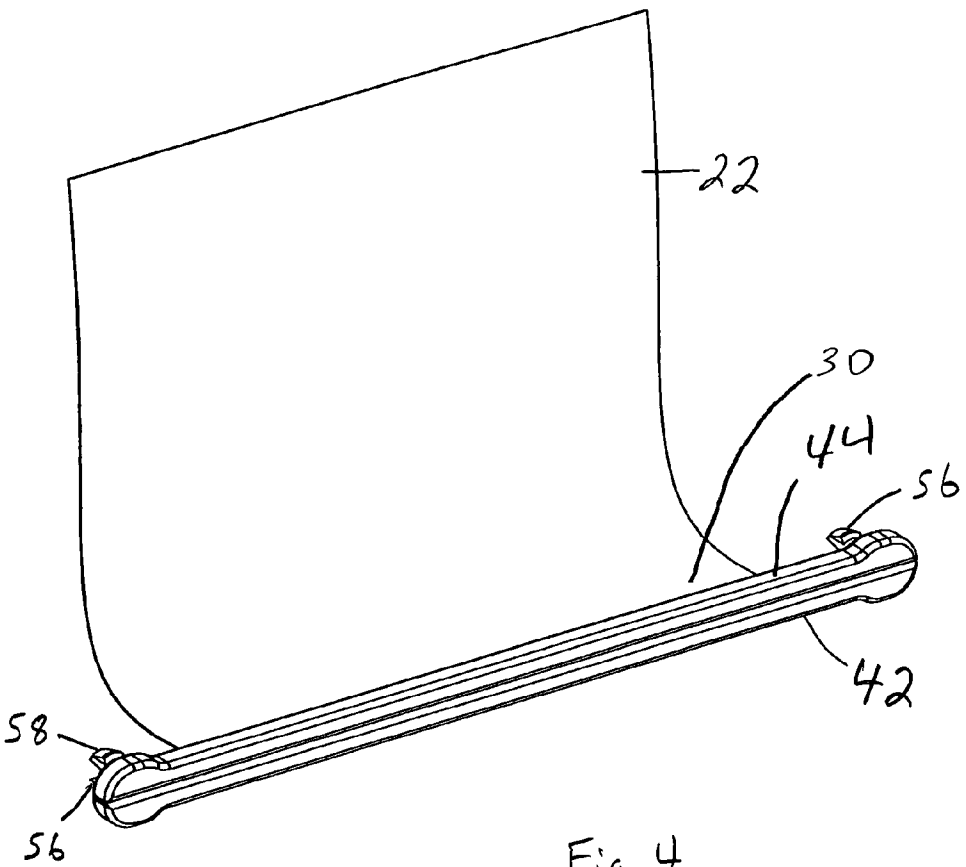
FIG. 4 is a perspective view of the adjustable mounting element shown in FIG. 3 used to clamp onto a support ribbon.

Referring now to FIG. 3, each adjustable support member includes a pair of identical elongated members 42 and 44. Each member has a tongue 46 at one end and a corresponding groove 48 at the other end with a flat surface 50 extending between them. Elongated members 42 and 44 are identical with the elongated members being oriented towards each other such that the tongues 46 are aligned with the grooves 48. End 30 of ribbon 22 is positioned between flat portions 50 of members 42 and 44 so that end 30 is clamped between members 42 and 44 when the two members are coupled together. Flat surface 50 has a plurality of bumps 52 and corresponding dimples 54 which are aligned when member 42 and 44 are coupled together and act to hold end 30 of ribbon 22 between the elongated members. The opposite ends of elongated members 42 and 44 have projecting fingers 56 and 58 which extend perpendicularly away from the elongated member relative to tongues 46 and grooves 48. When elongated members 42 and 44 are coupled together as illustrated in FIG. 4, fingers 56 of one elongated member is adjacent to and parallel with fingers 58 of the other member so that a pair of fingers extend from each end of the coupled elongated members.

Figure 5:
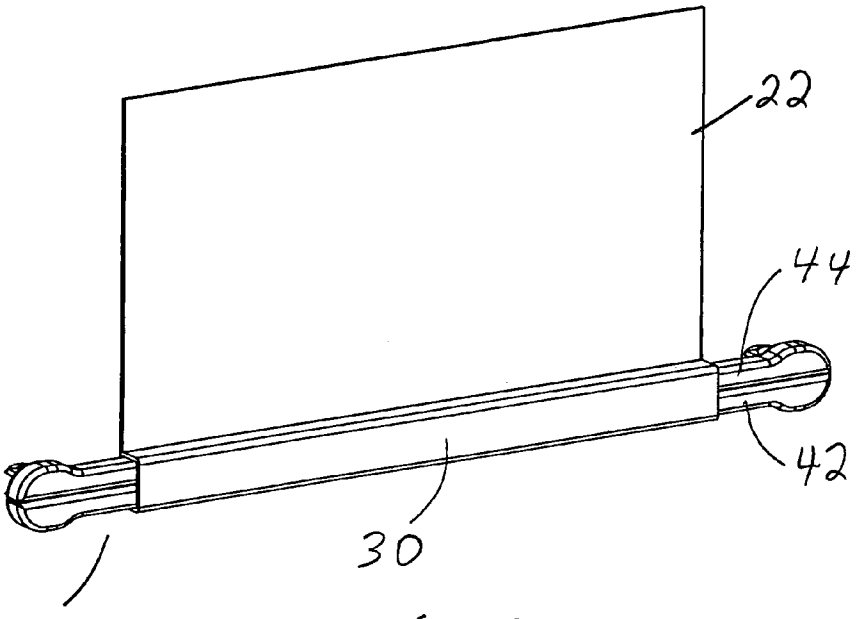
FIG. 5 is a perspective view of the adjustable mounting element shown in FIG. 4 with the support ribbon partially wrapped around the adjustable mounting element.

Referring now to FIG. 5, after the bottom (or lower) end of the ribbon is clamped between elongated members 44 and 42, it may be wrapped around the coupled elongated members. This provides a simple means for shortening the length of the support ribbon. By increasing the number of times (turns) the end of the ribbon is wrapped around the elongated members, the shorter the ribbon can be made. Elongated support members 42 and 44 act together as a spindle 61 upon which lower end 30 of ribbon 22 is wrapped. While ribbon 22 is illustrated in FIGS. 4 and 5, it will be appreciated that both of the support ribbons are identical, so each support ribbon can be adjusted to the correct length by selectively wrapping the end of each ribbon around elongated members 42 and 44 (spindle 61) until the desired length is achieved.

Figure 6:
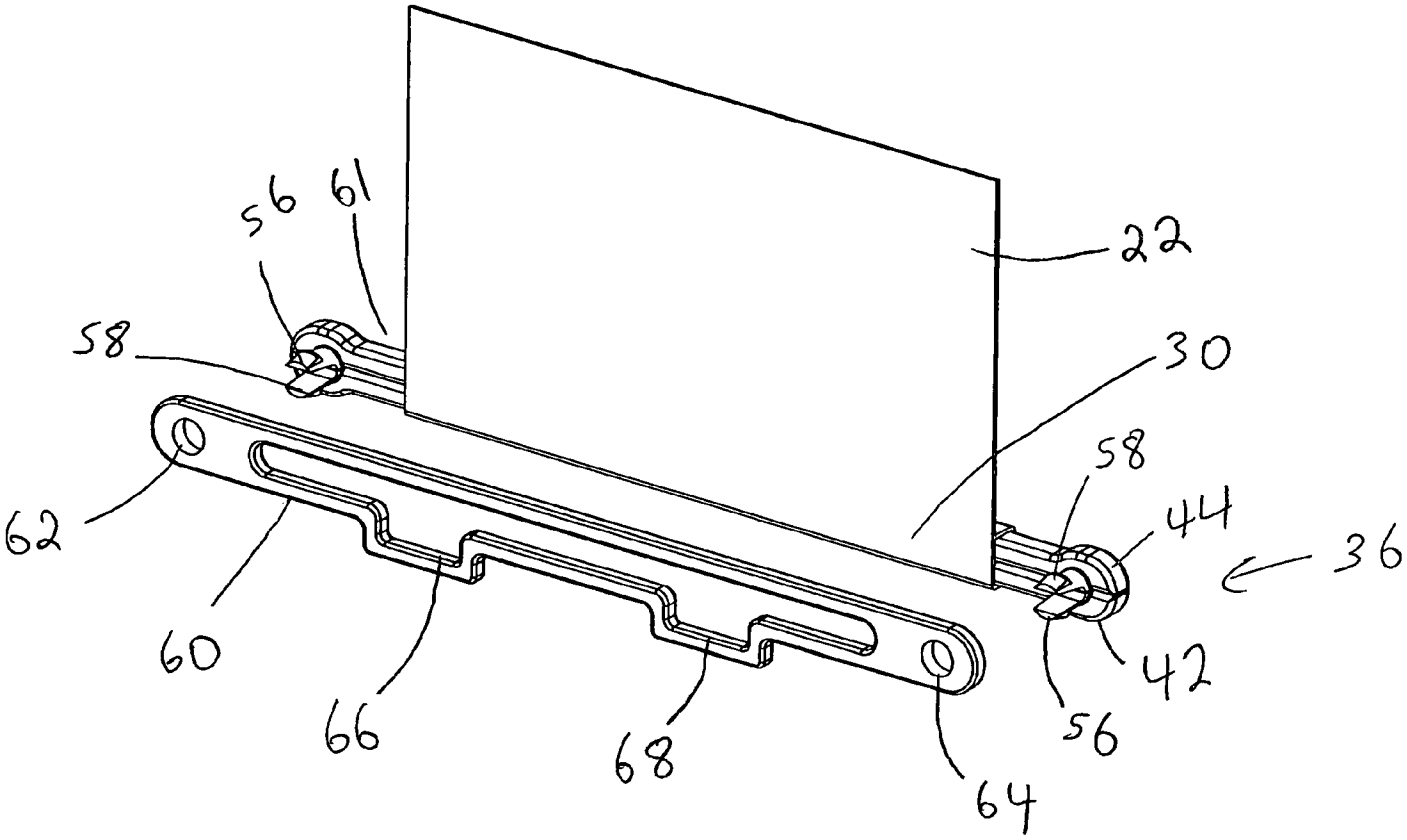
FIG. 6 is a perspective view of the adjustable mounting element shown in FIG. 5 with the locking member about to be attached thereto.

Referring now to FIG. 6, adjustable mounting element 36 includes a lock member 60, which is provided for locking ribbon 22 in place on spindle 61 (i.e. elongated members 42 and 44). After end 30 of ribbon 22 is wrapped around elongated members 44 and 42, the elongated members are positioned adjacent lock member 60 so as to align apertures 62 and 64 of the lock member with fingers 56 and 58 at either end of the coupled elongated members. Apertures 62 and 64 are dimensioned such that fingers 56 and 58 can be inserted together into each aperture. Fingers 56 and 58 are each configured such that once they are inserted into apertures 62 and 64 they are locked in place and cannot easily be removed. Once lock member 60 is locked onto elongated members 42 and 44, ribbon 22 cannot be unwrapped from the elongated members. Lock member 60 is provided with attachment points 66 and 68. As mentioned previously, the support ribbons are identical as are the adjustable mounting elements. While the features of adjustable mounting element 36 has been discussed in detail, it is to be understood that corresponding adjustable mounting element 38 (see FIG. 1) includes identical elongated members 42 and 44 and lock member 60.

Figure 7:
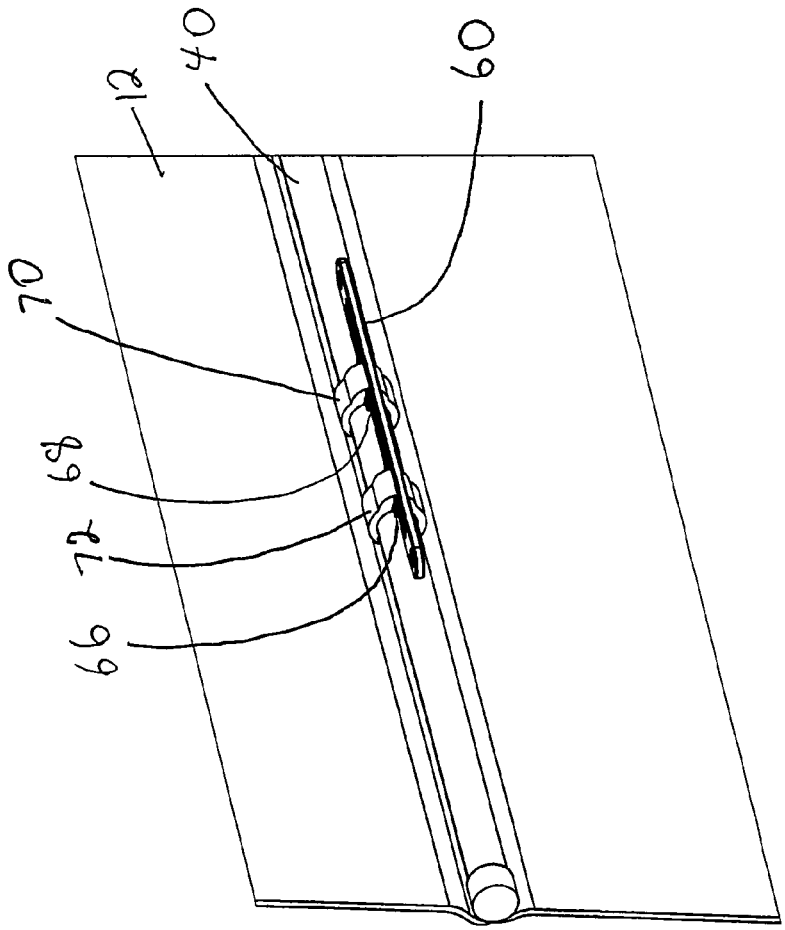
FIG. 7 is a perspective view of part of the roman blind shown in FIG. 1 showing the lock member coupled to the lowermost support rod.

As best seen in FIG. 7, lock member 60 can be mounted to lowermost horizontal support rod 40 by attachment members 70 and 72. Attachment members 70 and 72 consist of essentially "C shaped" semi-circular clamps which clamp around lowermost horizontal support rod 40. These "C shaped" clamps (attachment members) are dimensioned to fit within attachment points 66 and 68. Essentially, the "C shaped" clamps 70 and 72 are first attached to attachment points 68 and 66, respectively and then the clamps are attached to lowermost horizontal support rod 40. Attachment members 70 and 72 are made of a resilient plastic and can deform slightly in order to tightly clamp to support rod 40.

Figure 8:
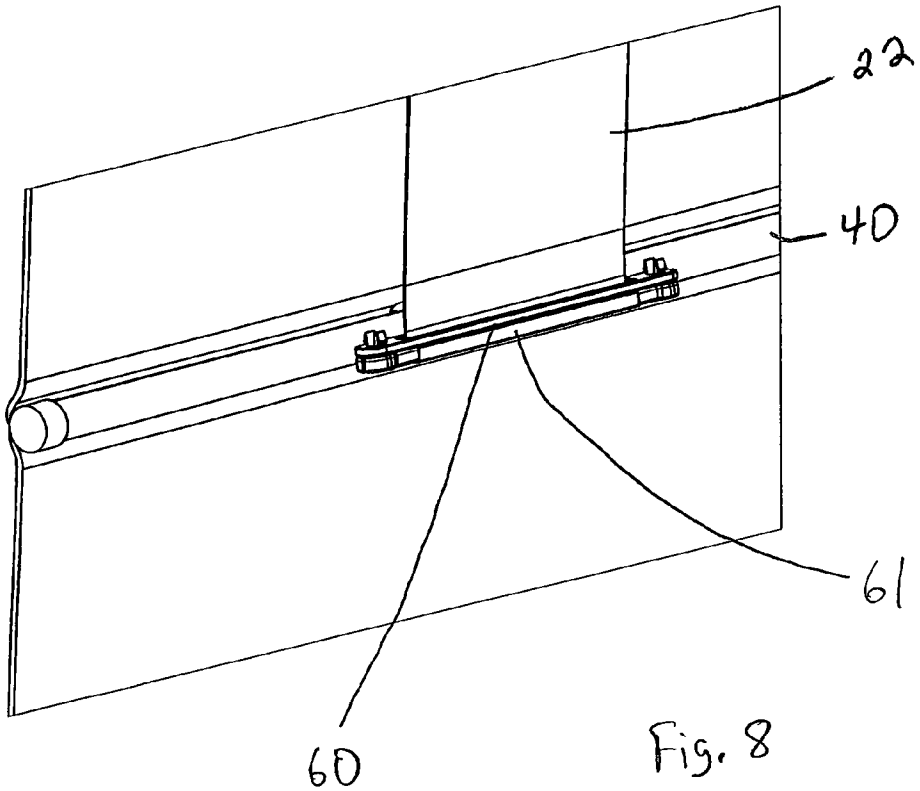
FIG. 8 is a perspective view of part of the roman blind shown in FIG. 1 showing the adjustable mounting element coupling the support ribbon to the lowermost support rod.

Referring now to FIG. 8, after lock member 60 is mounted to horizontal support rod 40, spindle 61 can be locked in place on the lock member. This effectively mounts the lowermost end of ribbon 22 to lowermost horizontal support rod 40.

Referring back to FIG. 1, the present invention allows the quick adjustments to be made to the lengths of support ribbons 22 and 24 without the need for accurately cutting the ribbons. If one of the support ribbons is too long, the adjustable mounting element (36 and or 38) can be adjusted so as to wrap more of the ribbon onto the mounting element, thereby effectively shortening the length of the ribbon. This allows for quicker and easier installation of the roman blind on site.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims Therefore, what is claimed is:

1. A roman blind comprising:

A shade having a top and bottom edge, a plurality of support bars mounted along the shade between the top and bottom edges of the shade in a parallel horizontal fashion;

Each of the support bars having a loop dimensioned to receive a lifting ribbon having opposite first and second ends;

A lift mechanism mounted to the top end of the shade, the lift mechanism being mounted to the first end of the lifting ribbon and configured to raise and lower the lifting ribbon;

An adjustable mounting element mounted to the second end of the lifting ribbon, the adjustable mounting element comprising first and second elongated members having opposite first and second ends, the opposite ends of the elongated members configured to couple the elongated members together and clamp the second end of the ribbon between the elongated members, a portion of the ribbon adjacent the second end being wrapped around the coupled elongated members;

The adjustable mounting element further comprising an elongated lock member having opposite ends, the lock member being dimensioned such that the opposite ends of the lock member align with and lock to the opposite ends of the elongated members preventing the ribbon from unwrapping off the elongated members, the elongated lock member having mounting elements for mounting to a lowermost support bar mounted adjacent the bottom edge of the shade.

2. The roman blind defined in claim 1 wherein the elongated members are identical, the first end of each elongated member comprising a tongue and a first finger and the second end of each elongated member comprising a groove and a second finger, a flat surface formed on each elongated member between the tongue and groove, the first and second fingers projecting perpendicularly from the elongated member relative to the tongue and groove, the tongues and grooves being configured to fit together when the first end of one elongated member is coupled to the second end of the other elongated member.

3. The roman blind defined in claim 2 wherein the elongated members are configured such that the first finger of one elongated member is parallel with and adjacent to the second finger of the other elongated member when the first and second elongated members are coupled together and wherein each end of the lock member is provided with an aperture dimensioned to receive the first and second fingers of the elongated members, the first and second fingers being configured to lock within the aperture when both are inserted.

4. The roman blind defined in claim 3 wherein the lock members are each attached to the lowermost horizontal support bar by a C-shaped clamp member configured to clamp to the lowermost horizontal support bar.

* * * * *